US006255591B1

(12) United States Patent
Ziemek

(10) Patent No.: US 6,255,591 B1
(45) Date of Patent: Jul. 3, 2001

(54) ELECTRIC CABLES WITH METALLIC PROTECTIVE SHEATHS

(76) Inventor: Gerhard Ziemek, Bunzlauer Str. 6, D-30853 Langenhagen (DE)

( * ) Notice: Subject to any disclaimer, the term of this patent is extended or adjusted under 35 U.S.C. 154(b) by 0 days.

(21) Appl. No.: 09/454,805

(22) Filed: Dec. 3, 1999

Related U.S. Application Data

(63) Continuation-in-part of application No. 09/170,462, filed on Oct. 13, 1998, now abandoned.

(51) Int. Cl.[7] ..... H01B 7/18

(52) U.S. Cl. ..... 174/102 R; 174/102 D

(58) Field of Search ..... 174/102 R, 102 A, 174/102 SC, 102 C, 102 SP, 102 D, 36

(56) References Cited

U.S. PATENT DOCUMENTS

| | | | | |
|---|---|---|---|---|
| 1,797,851 | * | 3/1931 | Bossert et al. . | |
| 3,582,536 | * | 6/1971 | Miller | 174/102 |
| 3,773,965 | * | 11/1973 | Reynolds | 174/25 G |
| 3,824,330 | * | 7/1974 | Lang | 174/102 D |
| 3,843,830 | * | 10/1974 | Priaroggia et al. | 174/102 D |
| 3,980,807 | * | 9/1976 | Woytiuk | 174/107 |
| 4,426,937 | * | 1/1984 | Miller | 138/108 |
| 4,749,823 | * | 6/1988 | Ziemek et al. | 174/103 |
| 5,189,719 | * | 2/1993 | Coleman et al. | 385/101 |
| 5,527,995 | * | 6/1996 | Lasky | 174/102 SC |
| 5,760,334 | * | 6/1998 | Ziemek | 174/28 |
| 5,919,517 | * | 7/1999 | Levendusky et al. | 427/211 |

* cited by examiner

*Primary Examiner*—Dean A. Reichard
*Assistant Examiner*—William H. Mayo, III

(57) ABSTRACT

An electric cable protected by a corrugated hollow metallic sheath composed of an aluminum alloy type 3004.

3 Claims, 3 Drawing Sheets

FIG. 3

| PROPERTY | 3003 | 3004 | 5052 | 5454 |
|---|---|---|---|---|
| COMPOSITION:<br>MANGANESE (0.5-3.0)<br>MAGNESIUM (1.5-3.0)<br>CHROMIUM (0-0.3) | <br>1.0-1.5<br>--<br>-- | <br>1.0-1.5<br>0.8-1.3<br>0 | <br>0.1 MAX<br>2.2-2.8<br>0.15-0.35 | <br>0.5-1.0<br>2.4-3.0<br>0.05-0.2 |
| TEMPER | 0 | 0 | 0 | 0 |
| DENSITY, $lb/in^3$ | 0.099 | 0.098 | 0.097 | 0.097 |
| CONDUCTIVITY, %IACS | 50 | 42 | 35 | 34 |
| RESISTIVITY, 20°C, nΩ-m<br>Ω-cmil/ft | 34.0<br>20.5 | 41.0<br>24.6 | 49.3<br>29.6 | 51.0<br>30.7 |
| TENSILE STRENGTH, psi | 16000 | 26000 | 28000 | 36000 |
| YEILD STRENGTH, psi | 6000 | 10000 | 13000 | 17000 |
| ELONGATION, % | 30-40 | 20-25 | 25-27 | 22 |
| HARDNESS, HB | 28 | 45 | 47 | 62 |
| HARDNESS, HR | 45-65 | NOT GIVEN | NOT GIVEN | NOT GIVEN |
| FATIGUE STRENGTH, psi | 7000 | 14000 | 16000 | 17000 |
| WELDABILITY, GAS<br>ARC | A<br>A | A<br>A | A<br>A | C<br>A |
| WORKABILITY | A | A | A | A |
| MACHINABILITY | E | D | D | D |
| CORROSION RESISTANCE | A | A | A | A |

ELECTRIC CABLES WITH METALLIC PROTECTIVE SHEATHS

CROSS REFERENCE TO APPLICATION

The present application is a continuation-in-part of application Ser. No. 09/170,462, filed Oct. 13, 1998, now abandoned, and entitled ELECTRIC CABLES WITH PROTECTIVE METALLIC SHEATHS.

BACKGROUND OF THE INVENTION

Electric cables often are installed in hazardous or corrosive environments. Such cables employ a core of circular diameter which is covered by an external metallic sheath used as a protective member. These sheaths provide an impervious metallic envelope capable of preventing entry of humidity and resisting corrosion caused for example by moisture, acids, gases and the like. Conventionally, such sheaths are formed from aluminum or aluminum-manganese alloys. These sheaths form a protective envelope. The thickness of the sheath depends in part upon the size of the core diameter and increases with increasing size.

The installation of the sheath about the core utilizes strips of aluminum metals or alloys which are formed around outer surface of the core of the cable and then are longitudinally welded and corrugated.

However, cables utilizing metallic sheaths, as for example heavy power cables, are normally manufactured in long lengths and are wound on reels. For cores of larger diameter employing thicker sheaths, the weight of the upper layers of sheathed cables causes the upper layers to crush downward against the lower cable layers, often causing some deformation of the sheath and core in the lower cable layers. This deformation creates problems in subsequent manufacturing steps such as jacket extrusion, cable termination and also in final installation in cable ducts. In addition, the cost of the sheath material increases substantially as the sheath thickness is increased.

The present invention is directed toward a metallic sheath which retains sufficient crush resistance to overcome the deformation problem while at the same time exhibiting a reduction in the sheath thickness which provides substantial reduction in the amount and cost of sheath material.

SUMMARY OF THE INVENTION

It is an object of the present invention to provide a known metallic alloy never previously used as a protective sheath for the cores of electric cables which when used as a sheath has sufficient strength to prevent deformation during processing and sufficient reduction in sheath thickness to produce a substantial reduction in cost of the sheath.

These and other objects and advantages of the invention will either be explained or will become apparent hereinafter.

The mechanical strength of a cable sheath is determined by a so-called "crush test" in which an empty metallic sheath in the form of a hollow tube is mounted between two platens and subjected to compression until the sheath collapses. It has been determined experimentally that in order to avoid undesirable deformation of the sheath when a sheathed cable is wound on a reel, the maximum acceptable deformation of the sheath should be limited to about 5% of the outer diameter under a compression force of 1000 pounds applied to a sheath specimen of 150 millimeters.

The deformation characteristics of aluminum alloys commonly used as cable sheaths and identified in the art as type 3003 are marginally acceptable. However when these characteristics were compared with the deformation characteristics of an aluminum alloy identified in the art as type 3004 and never before used as a cable sheath, it was found surprisingly that alloy 3004 displayed much improved deformation characteristics using the crush test. Moreover, it was found that for any given diameter of cable core, the increased deformation characteristics of alloy 3004 enabled an acceptable sheath of alloy 3004 to be much thinner than a corresponding sheath of alloy 3003.

In particular the D/S which is the ratio of the outer diameter D of a sheath to its thickness S provides a means of comparison of alloy 3004 and alloy 3003.

For example, when the D/S ratio of alloy 3003 is compared to the D/S ratio of alloy 3004, over a range of diameters D between 10 and 100 millimeters, and the sheath thickness of these two alloys are computed using these ratios for the same diameter value, the sheath thickness of the newly used alloy will always be at least 20% smaller than that of the commonly used alloy.

Consequently, the sheath thickness can be reduced substantially as for example by at least 20% while maintaining the desired crush resistance when a type 3004 metallic alloy is substituted for a type 3003 metallic alloy. Both these alloys have the same unit weight and same unit cost, so that this reduction in sheath thickness results in substantial cost reduction. Alloy types 5052 and 5454 have even higher D/S ratios and permit further reduction in sheath thickness, but are more expensive.

BRIEF DESCRIPTION OF THE DRAWINGS

FIG. 3 is a chart comparing properties of alloys 3003, 3004, 5052 and 5454.

DETAILED DESCRIPTION OF PREFERRED EMBODIMENTS

Figure 1:
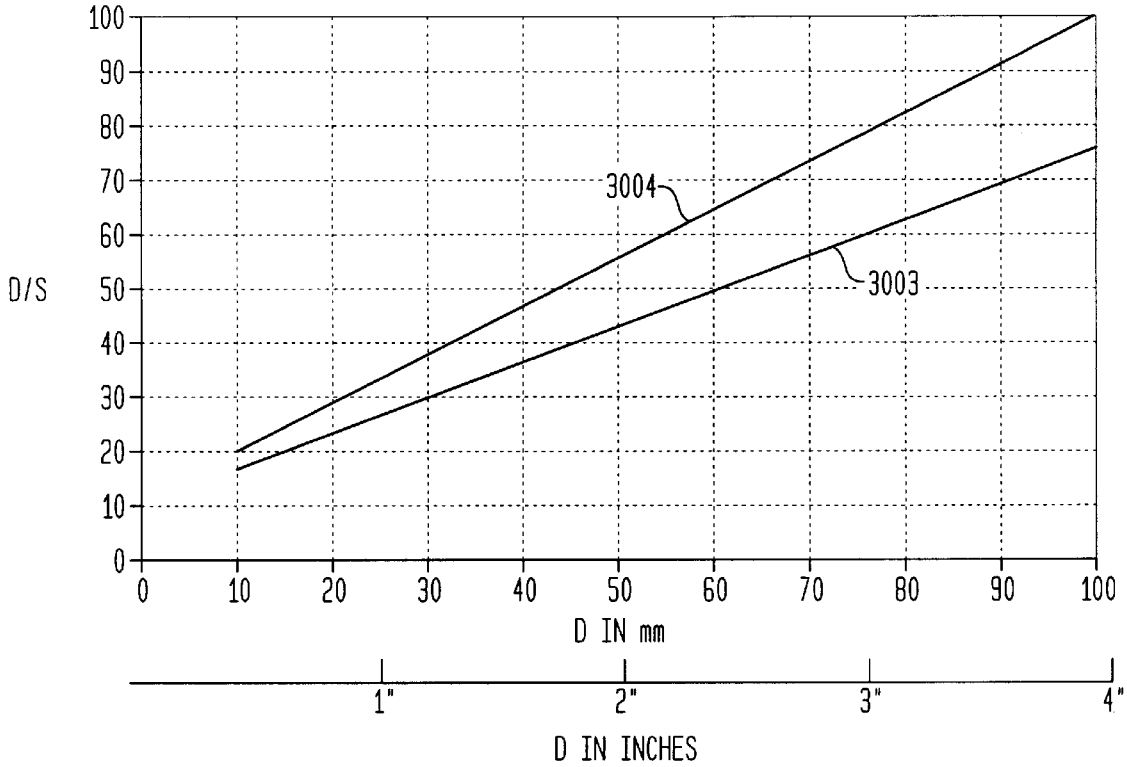
FIG. 1 is a graph plotting the relationship of D/S to D for alloys 3003 and 3004.
Figure 4:
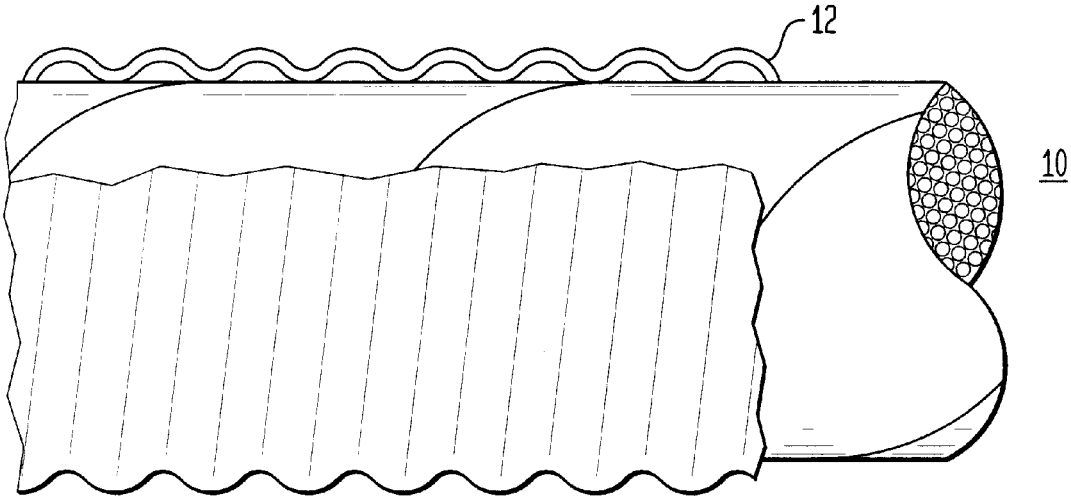
FIG. 4 is a longitudinal cross sectional view of a conventional electrical cable and corrugated metallic sheath.

Referring first to FIG. 4 illustrates a conventional cable 10 and corrugated metallic sheath 12. Referring now to the graph of FIG. 1, the D/S ratios, where D is the outer diameter of the corrugated metallic sheath and S is the thickness of the sheath, were measure and plotted against D for the alloy 3003 and for the alloy 3004. This graph demonstrates the advantages of alloy 3004 as compared to alloy 3003 in reduction of sheath thickness over a diameter range of 10 mm to 100 mm and a corresponding ratio range from 20 to 100.

For every value of the diameter D, the D/S ratio of the alloy 3004 is substantially higher than that of alloy 3003, whereby as explained previously, the sheath thickness of alloy 3004 is substantially reduced as compared to the sheath thickness of alloy 3003.

Figure 2:
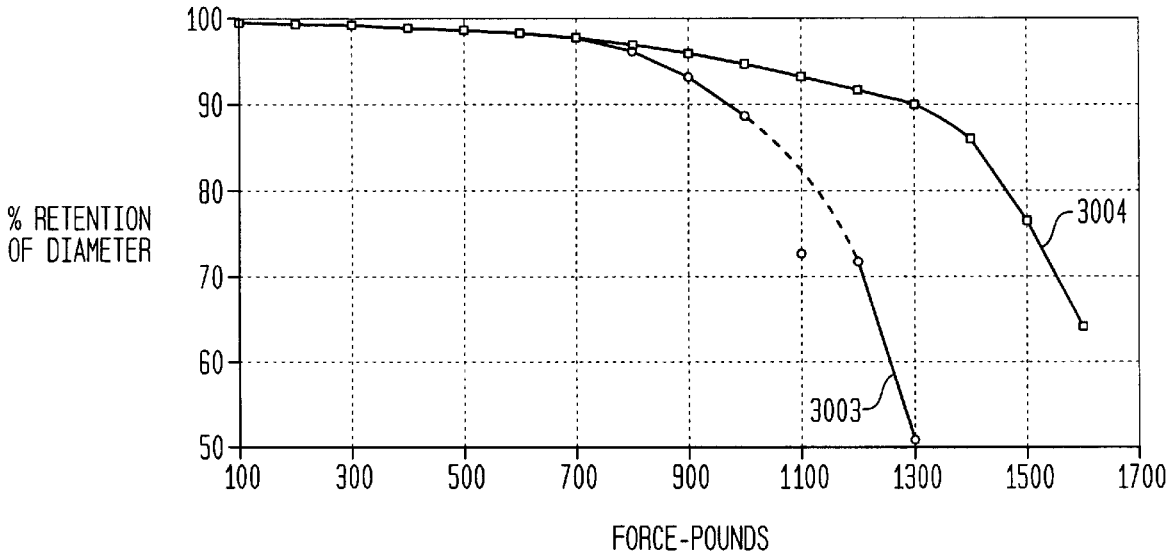
FIG. 2 is a graph plotting the relationship of percentage of retention of diameter [crush deformation] to deformation force for alloys 3003 and 3004.

Referring now to FIG. 2, surprisingly, the percentage of retention of the radial diameter of a specimen of alloy 3004 having a length of 150 mm when subjected increasing deformation force from 1000 to 1600 pounds decreased only from 95% to 65% while the percentage of retention of a like specimen of alloy decreased from an already unacceptable 89% to about 52% over a smaller range of 1000 to 1300 pounds.

FIG. 3 is a chart comparing the properties of alloy 3003, alloy 3004, and two additional alloys 5052 and 5454. These additional newly usable alloys are characterized by even higher crush resistance and even greater reduction of sheath thickness than alloy 3004, but are more expensive in application.

While the original tests of the newly used alloy did not enable the selection of a minimum value of sheath thickness for a given value of D, further tests resulted in the empirical discovery that the D/S ratio of alloy 3004 for a minimum value of S is approximately defined by the equation $$D/S=1.1[D]+10$$

where D and S are defined in millimeters or by the equivalent equation $$D/S=2.6[D]+10$$

where D and S are defined in inches.

Since the sheath fits snuggly over the core, the inner diameter of the sheath is approximately the same as the core diameter. The inner sheath diameter can be calculated once the thickness and outer diameter of the sheath can be determined using these equations. This enables the cable manufacturer to select the appropriate sheath thickness to be used for a given core diameter.

While the invention has been described with particular references to the drawings and detailed embodiments, the protection solicited is to be limited only by the terms of the claims which follow.

What is claimed is:

1. An electric cable protected by a corrugated hollow metallic sheath composed of an aluminum alloy having the following composition in percentages by weight: manganese 1.0–1.5, magnesium 0.8–1.3, balance aluminum; wherein a specimen of the hollow sheath having a length of 150 millimeters exhibits a radial deformation not exceeding 5% upon application of a crushing force of 1000 pounds; wherein the sheath has an outer diameter D and a sheath thickness S, where S is defined by the thickness of the sheath, said sheath having a D/S ratio approximately defined by the equation D/S=1.1[D]+10 wherein D and S are defined in millimeters or by the equivalent equation D/S=2.6[D]+10 wherein D and S are defined in inches: and wherein the range of the D/S ratio as plotted against D over a diameter range of 10 to 100 millimeters increases linearly from 20 at a diameter of 10 millimeters to 100 at a diameter of 100 millimeters.

2. An electric cable protected by a corrugated hollow metallic sheath composed of an aluminum alloy having the following composition in percentage by weight: manganese 1.0–1.5, magnesium 0.8–1.3, balance aluminum; wherein a specimen of the hollow sheath having a length of 150 millimeters exhibits a radial deformation not exceeding 5% upon application of a crushing force of 1000 pounds; wherein the sheath has an outer diameter D and a sheath thickness S, where S is defined by the thickness of the sheath, said sheath having a D/S ratio approximately defined by the equation D/S=1.1[D]+10 wherein D and S are defined in millimeters or by the equivalent equation D/S=2.6[D]+10 wherein D and S are defined in inches: and wherein an increase in the crushing force applied to the specimen within the range of 1000 to 1600 pounds produced a corresponding decrease within the range 95% to 0.65% in the radial diameter of the specimen.

3. An electric cable protected by a corrugated hollow metallic sheath composed of an aluminum alloy having the following composition in percentage by weight: manganese 1.0–1.5, magnesium 0.8–1.3, balance aluminum; wherein a specimen of the hollow sheath having a length of 150 millimeters exhibits a radial deformation not exceeding 5% upon application of a crushing force of 1000 pounds; wherein the sheath has an outer diameter D and a sheath thickness S, where S is defined by the thickness of the sheath, said sheath having a D/S ratio approximately defined by the equation D/S=1.1[D]+10 wherein D and S are defined in millimeters or by the equivalent equation D/S=2.6[D]+10 wherein D and S are defined in inches: and wherein an increase in the crushing force applied to the specimen within the range of 1000 to 1600 pounds produced a corresponding decrease within the range 95% to 0.65% in the radial diameter of the specimen: and wherein the range of the D/S ratio as plotted against D over a diameter range of 10 to 100 millimeters increases linearly from 20 at a diameter of 10 millimeters to 100 at a diameter of 100 millimeters.

* * * * *